US005648794A

United States Patent [19]

Jelsma et al.

[11] Patent Number: 5,648,794

[45] Date of Patent: Jul. 15, 1997

[54] DISPLAY DEVICE

[75] Inventors: Siebe Jelsma; Karel E. Kuijk, both of Eindhoven, Netherlands

[73] Assignee: U.S. Philips Corporation, New York, N.Y.

[21] Appl. No.: 405,066

[22] Filed: Mar. 16, 1995

[30] Foreign Application Priority Data

Mar. 23, 1994 [EP] European Pat. Off. ..... 94200754

[51] Int. Cl.[6] ..... G09G 3/36

[52] U.S. Cl. ..... 345/98; 345/90; 349/41; 349/151

[58] Field of Search ..... 345/90, 91, 96, 345/98, 99, 100; 359/60; 349/33, 37, 41, 42, 43, 48, 49, 51, 143, 151

[56] References Cited

U.S. PATENT DOCUMENTS

| | | | |
|---|---|---|---|
| 4,109,241 | 8/1978 | Shanks | 345/98 |
| 4,465,999 | 8/1984 | Tsuzuki et al. | 340/784 |
| 4,710,768 | 12/1987 | Takeda et al. | 340/805 |
| 5,032,830 | 7/1991 | Kuijk | 340/784 |
| 5,032,831 | 7/1991 | Kuijk | 340/784 |
| 5,151,691 | 9/1992 | Kuijk | 340/784 |
| 5,159,325 | 10/1992 | Kuijk et al. | 340/783 |
| 5,229,761 | 7/1993 | Fuse | 340/784 |
| 5,283,565 | 2/1994 | Suzuki et al. | 345/98 |
| 5,379,050 | 1/1995 | Annis et al. | 345/94 |

*Primary Examiner*—Mark R. Powell
*Assistant Examiner*—Vincent E. Kovalick
*Attorney, Agent, or Firm*—Robert J. Kraus

[57] ABSTRACT

To prevent burn-in of images, notably with pixels (14) driven via non-linear two-pole switching elements (8), a display device is controlled in such a way that the charge transport through the two-pole element is substantially independent of the grey level. Capacitance variations due to pixel voltage variations are compensated by adapting the voltage change across the pixel (14) via extra reset signals and/or compensation signals.

21 Claims, 7 Drawing Sheets

DISPLAY DEVICE

Figure 1:
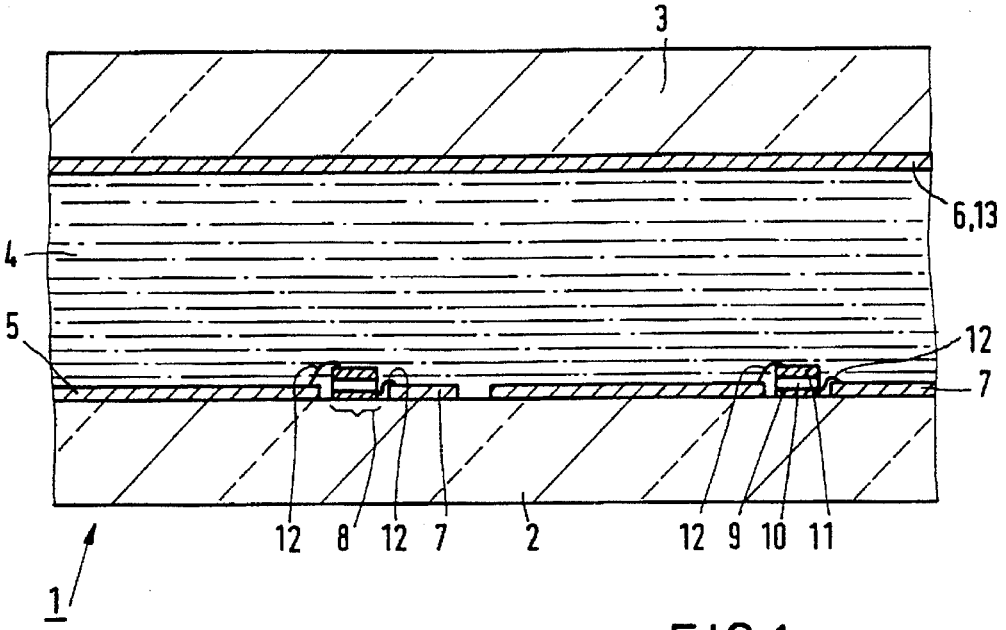

The invention relates to a display device comprising an electro-optical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with the given state of light transmissivity.

In this Application a non-linear switching element is understood to mean a switching element whose current-voltage characteristic has a non-linear current increase or decrease. In its current-voltage behaviour, this switching element may be substantially symmetrical around the origin, such as, for example a MIM (Metal-Isolator-Metal) device, a back-to-back diode or, for example a diode ring; in its current-voltage behaviour, the switching element may also be asymmetrical around the origin, such as, for example a zener diode. The switching element may comprise a plurality of sub-elements, for example for redundance.

The display devices may be liquid crystal display devices and are used, for example in television applications and datagraphic display devices.

A display device of the type described in the opening paragraph is known from U.S. Pat. No. 5,159,325. This Patent describes such a device with drive means which are adapted in such a way that uniformity of the image is obtained in that variations in forward voltages of the non-linear switching elements are compensated for.

Notably if the electro-optical display medium is a twisted nematic liquid crystalline medium and if MIMs (Metal-Isolator-Metal) are chosen for the non-linear switching elements, the phenomenon of burn-in (residual images) occurs. Dark characters on a light background in datagraphic applications then remain visible after selection of other characters.

It is, inter alia an object of the invention to provide a display device in which the phenomenon of burn-in is suppressed.

To this end a display device according to the invention is characterized in that the drive means are provided with means for limiting the maximum ratio between the charge transport for pixels having an arbitrary light transmissivity and the charge transport for pixels having an extreme light transmissivity during a full drive cycle to a value smaller than $$\frac{C_{pmax}}{C_{pmin}},$$

in which $C_{pmax}$ and $C_{pmin}$ are the maximum and minimum values between which the capacitance of a capacitor associated with the pixel varies during operation.

In this Application a full drive cycle is understood to mean a succession of two (or a number of pairs of) periods in which a pixel is consecutively charged in a given sense (positive or negative) in the first period and is charged in the opposite sense in the second period. In television applications this implies the consecutive writing, in a row, of information of successive lines of consecutive (even and odd) fields.

The invention is based on the recognition that the difference in charge transport for pixels of different brightness can be considered as the reason for the burn-in phenomenon. By adapting the drive means in such a way that the charge transport for pixels of different light transmissivity is less different during a full drive cycle than in the known device, the burn-in phenomenon is reduced.

Since the current through the switching elements always flows in the same direction during selection, a variation in forward voltages of the switching elements is compensated for and a uniform image is obtained.

Said ratio is usually determined with respect to the pixel having the smallest capacitance; for twisted nematic liquid crystalline material having a positive dielectric constant, this relates generally the voltageless state; for crossed polarizers this corresponds to a white pixel.

The maximum ratio of the charge transport for pixels having a second extreme light transmissivity (for example, white) with respect to the charge transport for pixels having the extreme light transmissivity (for example, black) during a full drive cycle is limited to a value of between 0.7 and 1.5.

The charge transport can be equalized in different manners, for example by means of a second auxiliary voltage.

A first preferred embodiment of a display device according to the invention is therefore characterized in that the drive means are provided with means for charging the pixel to a second auxiliary voltage beyond or on the edge of the voltage range to be used for picture display.

By making use of the second auxiliary voltage, it is achieved that notably the charge transport for both white and black pixels has substantially the same value so that said ratio has a value of approximately 1.

The drive means are preferably provided with means for charging the pixel to a second auxiliary voltage which has the same sign as the first auxiliary voltage and for subsequently charging the pixel to a voltage having an opposite sign and a smaller amplitude associated with the given state of light transmissivity.

Notably when the two auxiliary voltages have the same value, the control circuit supplying said auxiliary voltages can be implemented in a simpler way.

Said difference in charge transport may be such for intermediate transmission values (between white and black) that the ratio of the charge transport at the intermediate transmission value with respect to the charge transport at the extreme transmission value differs from 1 (is notably more than 1). An embodiment complying therewith is characterized in that the drive means are provided with means for applying compensation voltages to the column electrodes during the presentation of reset voltages during periods which are shorter than a row selection period. The reset voltages are presented to the row electrode so as to apply the auxiliary voltages to the associated pixels.

A further preferred embodiment of a display device according to the invention is characterized in that the means for charging the pixel to a first auxiliary voltage comprise a row selection circuit for presenting reset voltages during a period which is shorter than a row selection period and means for applying compensation voltages to the column electrodes during presentation of the reset voltages. Dependent on the presented data signal, the associated compensation voltages can now be chosen to be such that the voltage variations across pixels of different grey levels are such that the associated charge transport ratio approximates the value of 1 as much as possible.

These and other aspects of the invention will be apparent from and elucidated with reference to the embodiments described hereinafter.

In the drawings

Figure 2:
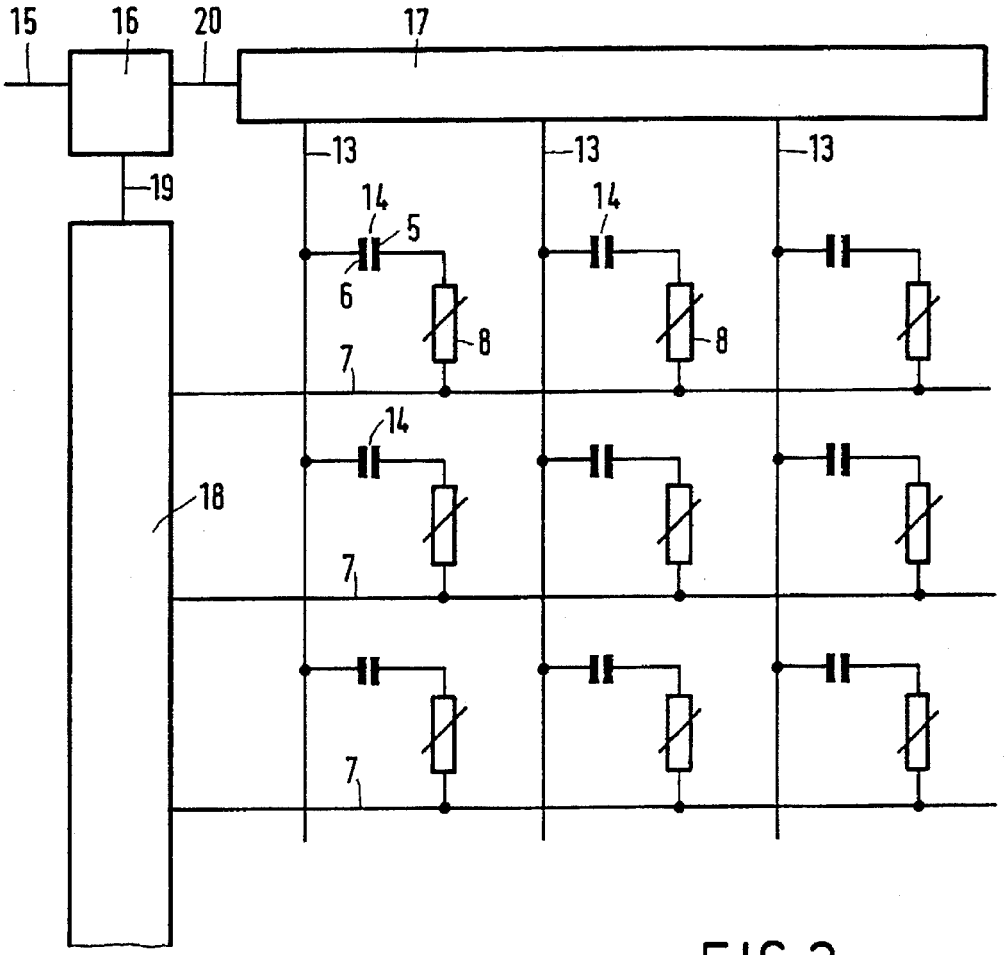
Figure 3:
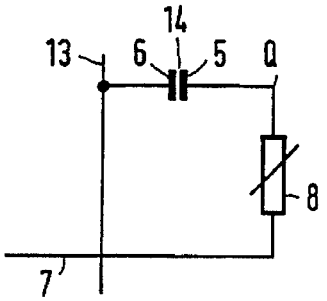
Figure 4A:
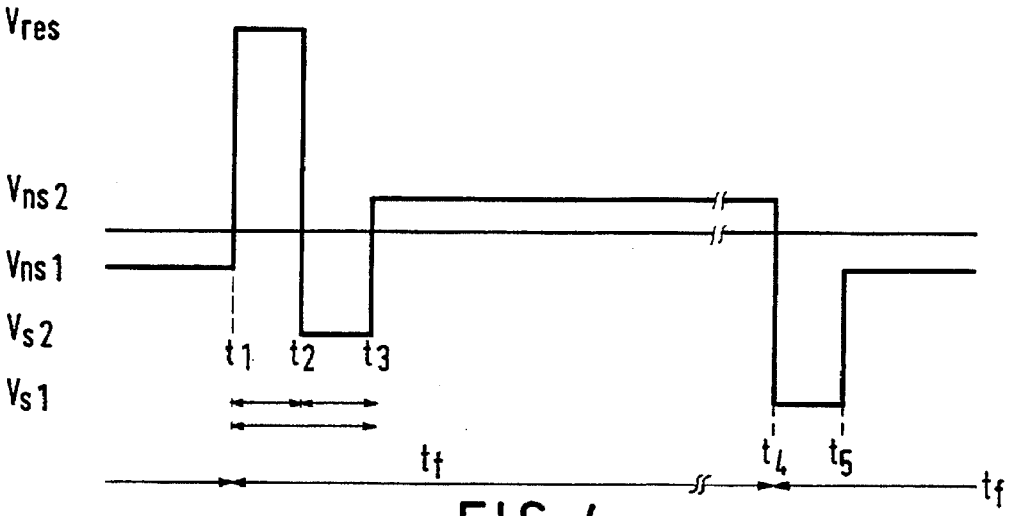
Figure 4B:
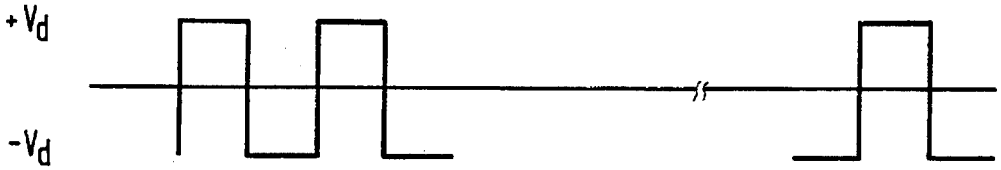
Figure 4C:
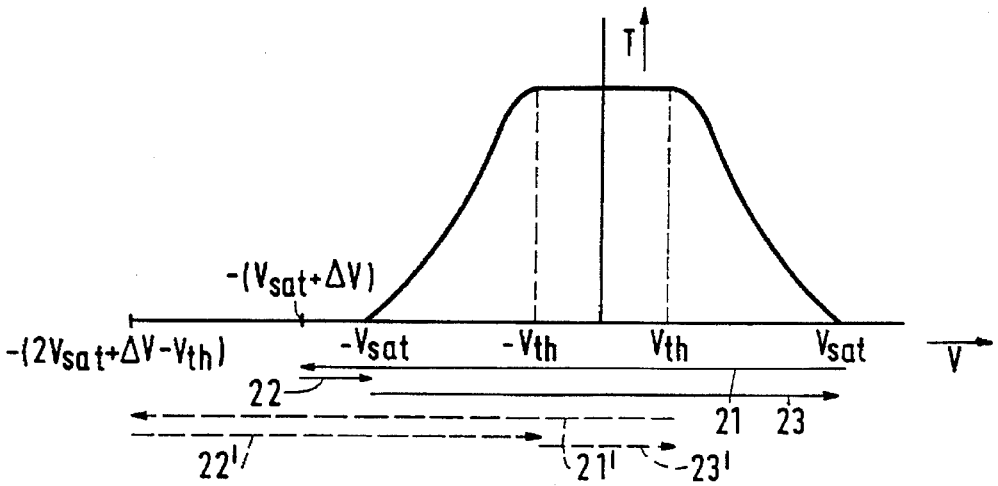
Figure 5A:
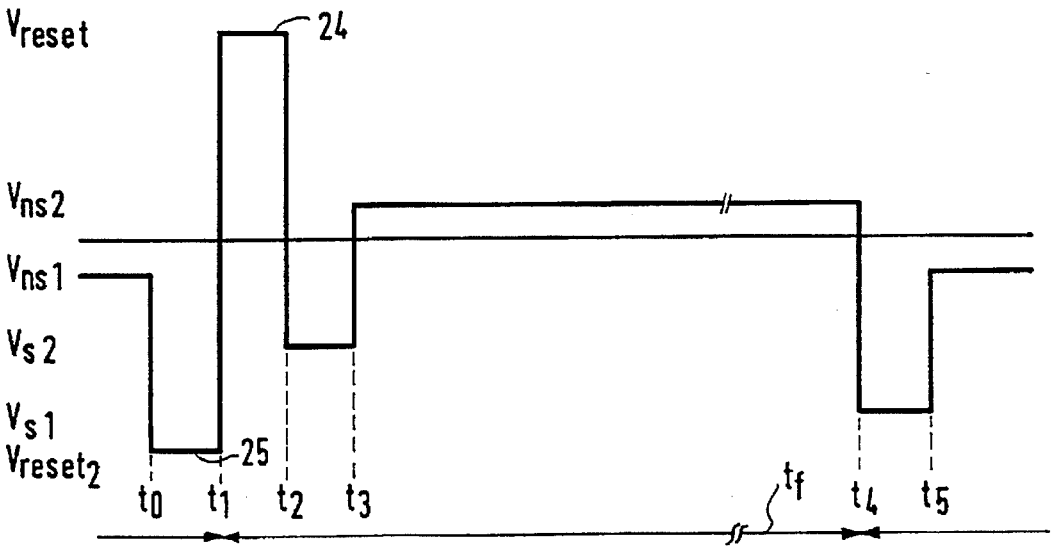
Figure 5B:
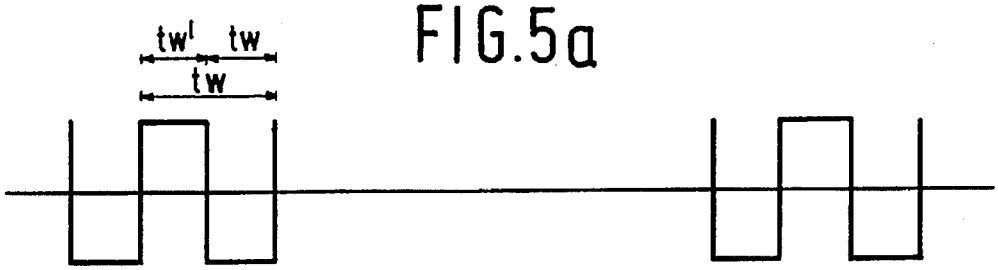
Figure 5C:
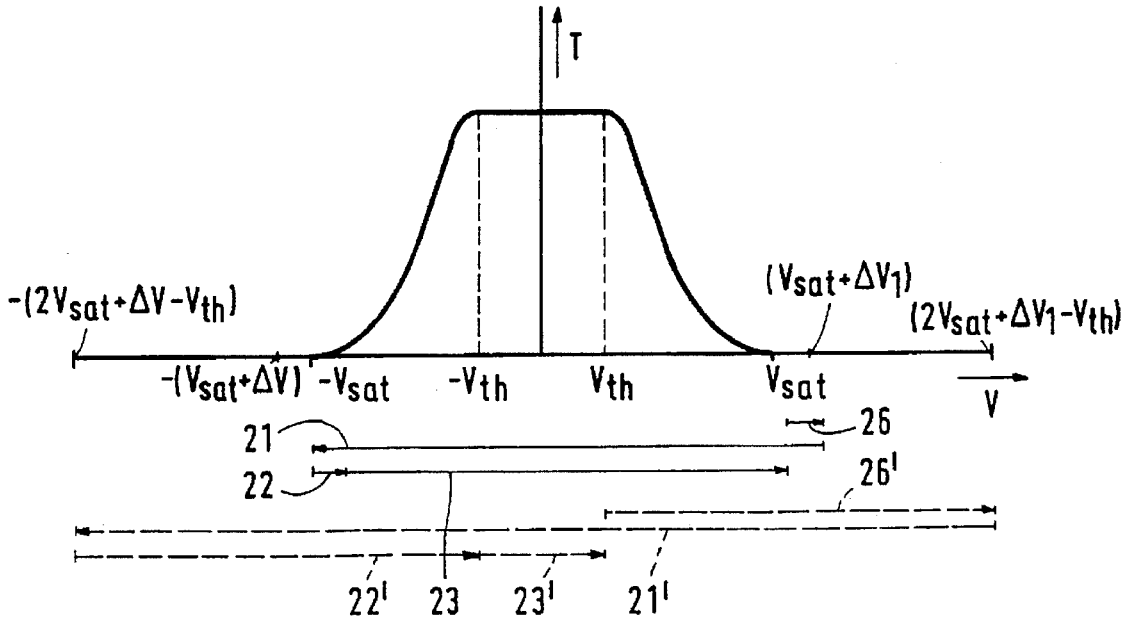
Figure 6:
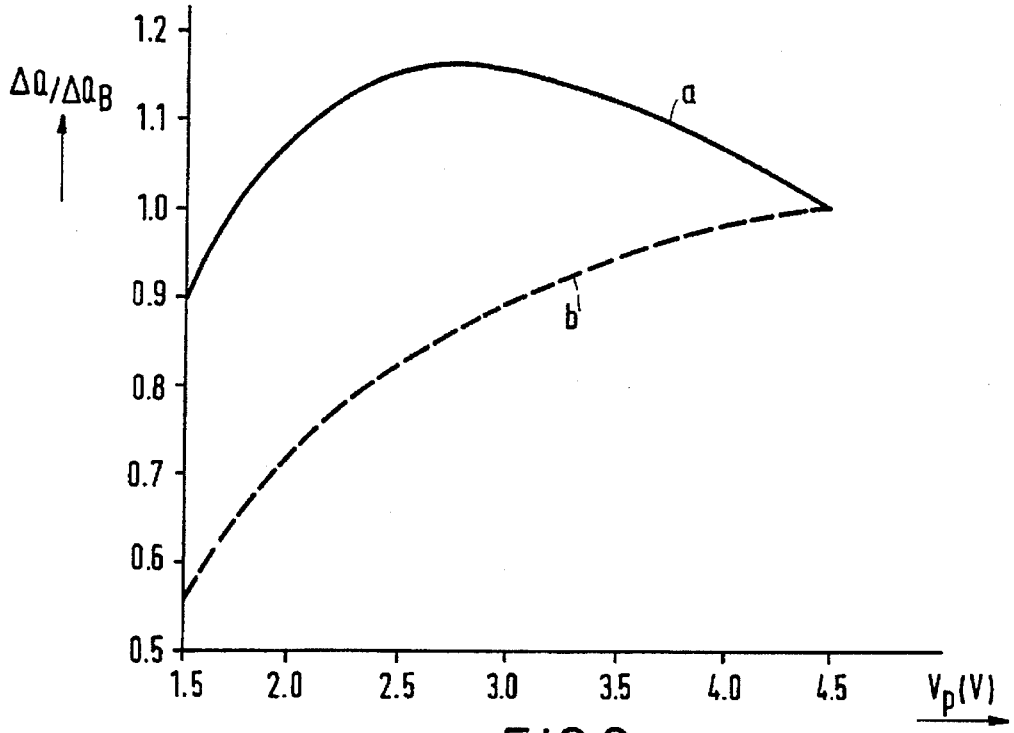
Figure 9:
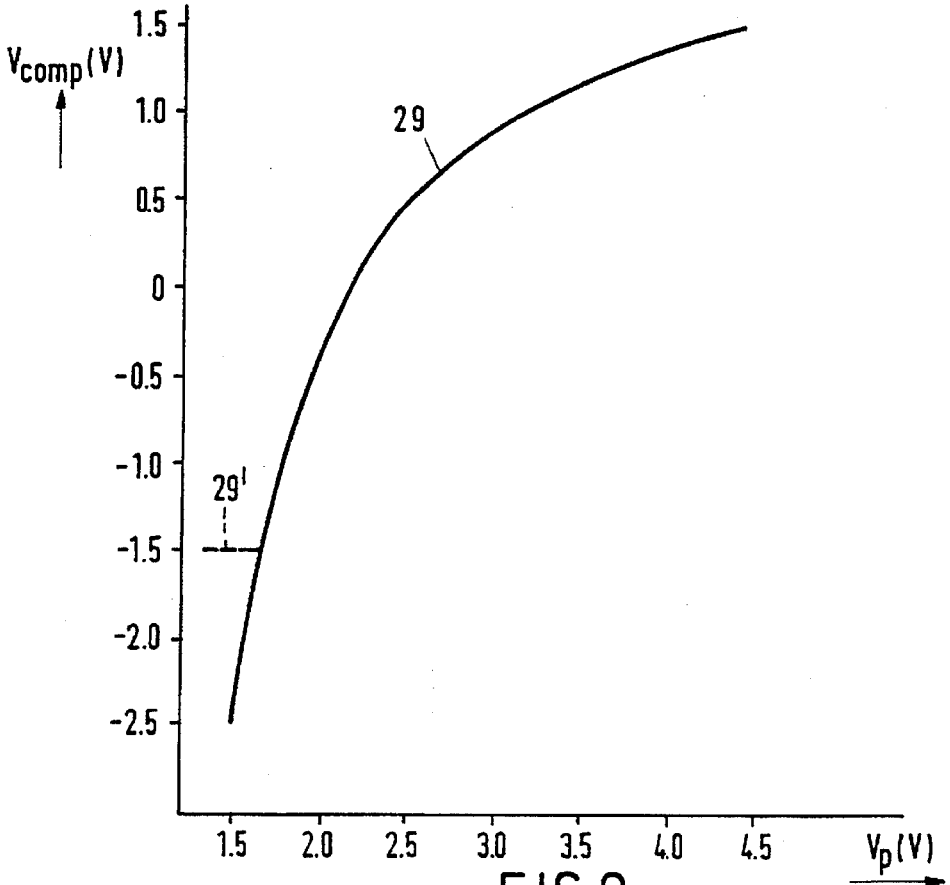
Figure 7A:
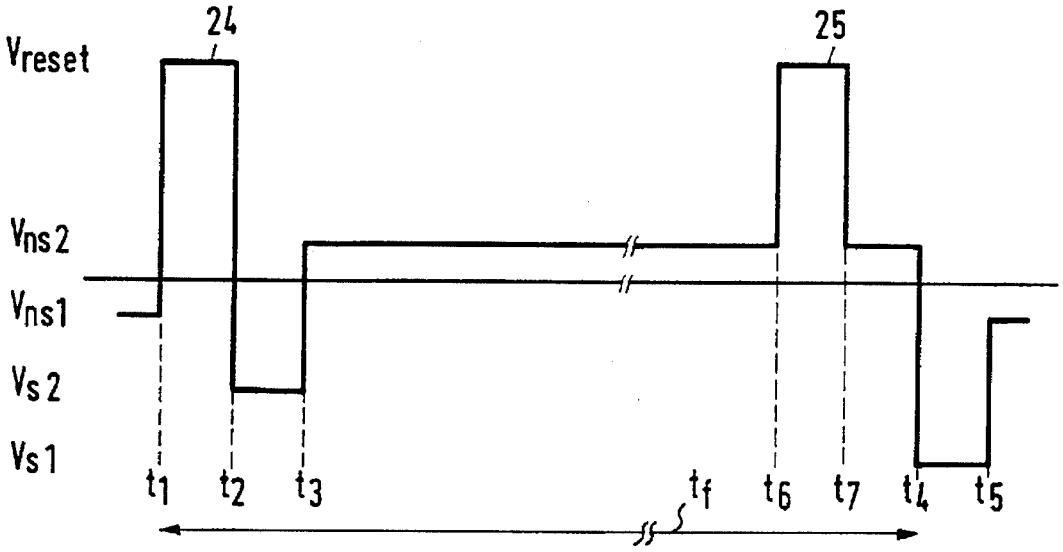
Figure 7B:
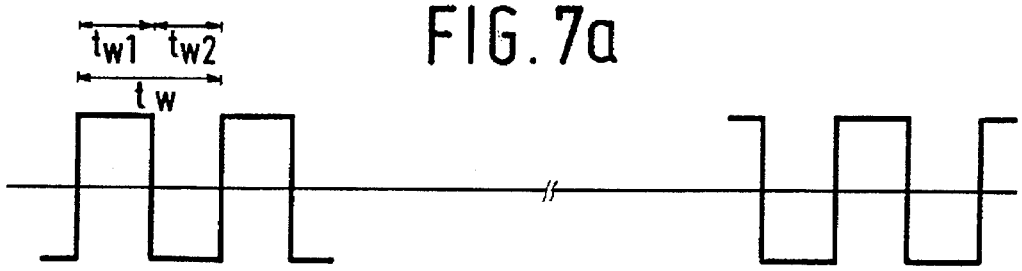
Figure 7C:
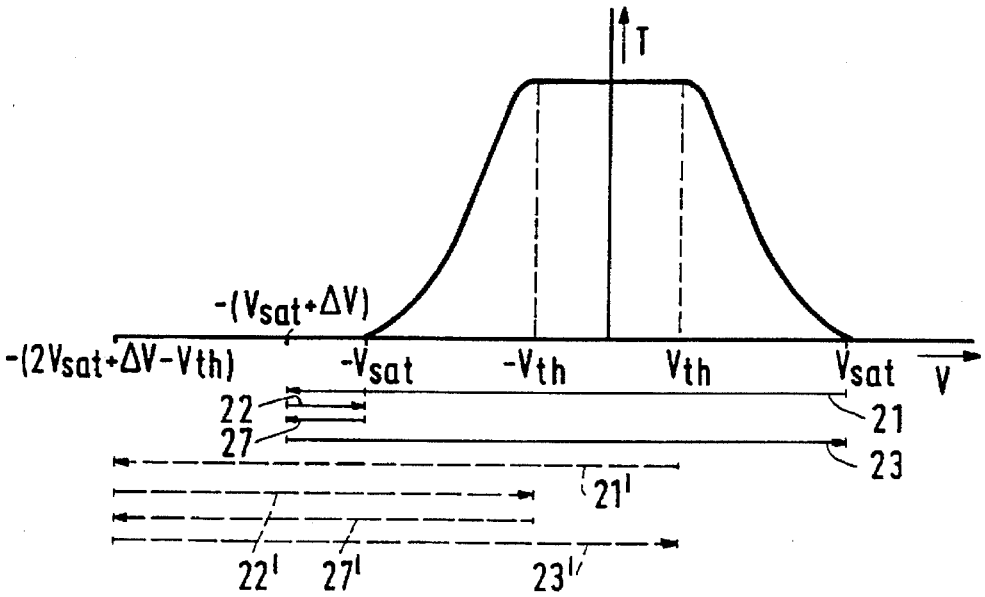
Figure 10:
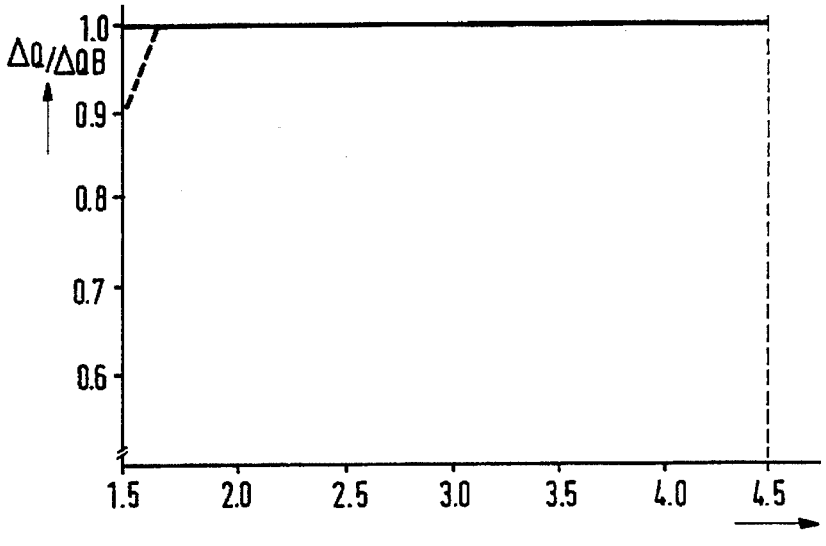
Figure 11A:
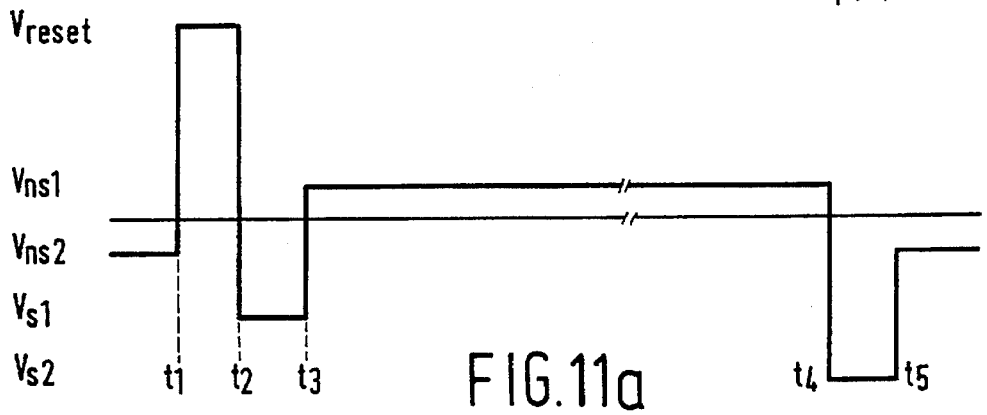
Figure 11B:
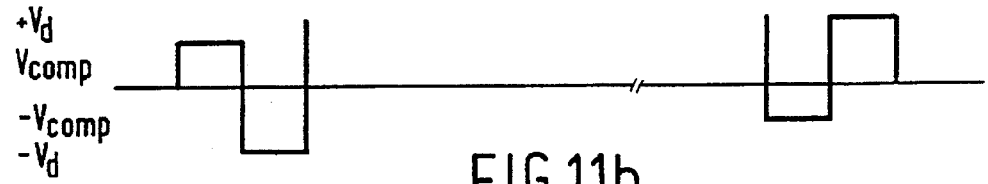
Figure 11C:
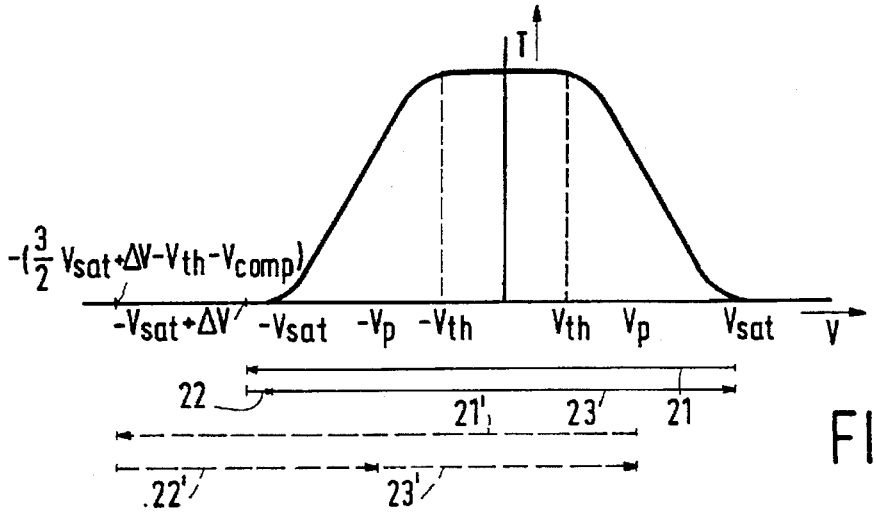

FIG. 1 is a diagrammatic cross-section of a part of a display device according to the invention, FIG. 2 shows diagrammatically a part of a display device according to the invention, FIG. 3 shows the substitution diagram of a single pixel with an associated switching element, FIGS. 4*a*, 4*b* and 4*c* show the row selection and data signals and a voltage-transmission characteristic for a known device, FIGS. 5*a*, 5*b* and 5*c* show the row selection and data signals and a voltage-transmission characteristic for a device according to the invention, FIG. 6 shows the charge transport as a function of the pixel voltage for the devices of FIGS. 5 and 6, FIGS. 7*a*, 7*b* and 7*c* show the row selection and data signals and a voltage-transmission characteristic for a modification of the device of FIG. 5, FIGS. 8*a*, 8*b* and 8*c* show the row selection and data signals and a voltage-transmission characteristic for a modification of the device of FIG. 7, FIG. 9 shows a compensation voltage as a function of the pixel voltage for the device of FIG. 7, while FIG. 10 shows the charge transport as a function of the pixel voltage, and FIGS. 11*a*, 11*b* and 11*c* show the row selection and data signals and a voltage-transmission characteristic for a further device according to the invention.

The drawings are diagrammatic and not to scale. Corresponding elements generally have the same reference numerals.

FIG. 1 is a diagrammatic cross-section of a part of a display device 1 which is provided with two supporting plates 2 and 3 between which an electro-optical display medium 4, in this example a liquid crystalline material is present. The inner surfaces of the supporting plates 2 and 3 are provided with picture electrodes 5 and 6 which, together with the intermediate liquid crystalline material, define a large number of pixels arranged in rows and columns. Strip-shaped row electrodes 7 which are connected to the picture electrodes 5 via non-linear switching elements 8, in this example MIMs, are arranged between the columns of picture electrodes 5. The MIMs are composed of a metal layer 9, a dielectric 10, for example (stoichiometric) silicon nitride or tantalum oxide, and a metal layer 11. The connections are outside the plane of the drawing and are denoted diagrammatically by means of the lines 12. In this example the picture electrodes 6 are integrated with column electrodes 13. Moreover, orienting layers (not shown) are provided on the inner surfaces of the supporting plates 2 and 3. The display device may be further provided with polarizers and may be both a transmissive and a reflective device.

FIG. 2 shows diagrammatically a part of such a display device. Here, the pixels 14 are connected via the picture electrodes 6 to the column electrodes 13 which, together with the row electrodes 7, are arranged in the form of a matrix in this example. The pixels 14 are connected to the row or selection electrodes 7 via the picture electrodes 5 and the non-linear switching elements (the MIMs 8). An incoming signal 15 is stored via a processing/control unit 16 in a data register 17 which presents the data signals or voltages (adapted, if necessary) to the column electrodes 13 in a manner to be described hereinafter. These data signals determine the light transmissivity to be realised for the pixels 14. To this end, the control unit 18 provides the row electrodes with selection signals. The control unit 16 synchronizes the operation of the control unit 18 and the data register 17 via lines 19 and 20.

FIG. 3 shows diagrammatically a single pixel 14 with the associated MIM 8 and row electrode 7 and column electrode 13. Usually, the variation of the selection and data voltages is chosen to be such that the voltage across a pixel regularly changes sign so as to inhibit degradation phenomena of the liquid crystalline material. In a twisted nematic display device, the voltage variation across a pixel (when using crossed polarizers) can be chosen between a threshold voltage $V_{thr}$ (the pixel is light transmissive and has a capacitance $Cp_{min}$) and a saturation voltage $V_{sat}$ (the pixel is light opaque and has a capacitance $Cp_{max}$). If said change takes place for a drive system using one selection voltage and one non-selection voltage, the charge across the pixel changes between +Cp.V and −Cp.V (Cp: pixel capacitance, V: voltage across the pixel). The total charge transport through the non-linear two-pole element at such a change is therefore $\Delta V=2Cp.V$. The charge transport ratio between an opaque pixel and a transmissive pixel is $(2Cp_{max}.V_{sat}/2Cp_{min}.V_{thr})$, i.e. $Cp_{max}.V_{sat}/Cp_{min}.V_{thr}$. At a customary ratio (for, for example liquid crystal material ZLI 84460 of the firm of Merck) it holds that $Cp_{max}=1.8.Cp_{min}$ and $V_{thr}=1.5$ volt, $V_{sat}=4.5$ volts. Said charge transport ratio between light opaque (black) and light transmissive (white) pixels $\Delta Q_B/\Delta Q_W$ then has a value of approximately 5.4. This charge transport difference is usually considered as the reason for the burn-in phenomenon, i.e. the phenomenon, notably in stationary images, at which the previous image contents still remain visible for some time after a change of the image contents.

FIGS. 4*a* and 4*b* show the row signals at two consecutive row electrodes 7 and a column electrode 13, while FIG. 4*c* shows a transmission-voltage characteristic for the pixel 14. At a voltage of 0 volt, the transmission is maximal; at an increasing value of the voltage across the picture electrodes 5, 6 in a positive or negative sense, the transmission starts to decrease at $\pm V_{th}$ until it is substantially negligible at $\pm V_{sat}$. When the display device is driven in the way as described in U.S. Pat. No. 5,159,325, a reset voltage $V_{res}$ is presented to the row electrode at instant $t_1$, which reset voltage charges the capacitance $C_p$ associated with the pixel 14 to a value $-(V_{sat}+\Delta V)$ (FIG. 4*c*), which is low enough to bring the pixel to an extreme transmission state. Subsequently a selection voltage $V_{s2}$ is presented from the instant $t_2$ to the instant $t_3$, while a voltage $-V_d$ (inverted data signal) is simultaneously presented to the column electrode. From $t_3$ the row electrode is no longer selected because a non-selection voltage (hold voltage) $V_{ns2}$ is presented. In a subsequent frame time $t_f$ a selection signal $V_{s1}$ is presented to the row electrode during selection (from $t_4$), while the data signal $+V_d$ is presented to the column electrode. The voltage $V_p$ across the pixel is inverted and the associated charge transport through the MIM is $\Delta Q=2.C_p.V_p$. From $t_5$ the row is no longer selected and there is no charge transport (a non-selection voltage (hold voltage) $V_{ns1}$ is presented to the row electrode 7).

In a subsequent cycle a reset voltage $V_{res}$ is again presented to the row electrode 7 at $t_1$. To be able to charge the capacitance $C_p$ associated with the pixel 14 to a voltage of at least $(V_{sat}+\Delta V)$ in the extreme case (at a maximum data voltage $V_{dmax}$ at the column electrode 13), it should hold for the reset voltage that:

$$V_{res} \geqq (V_{sat}+\Delta V)+V_{on}+V_{dmax} \quad (1)$$

$V_{on}$: forward voltage MIM during charging $\Delta V$ is the extra voltage difference for realising a good reset.

In U.S. Pat. No. 5,159,325 it has been derived for the data and selection voltages that:

$$-\tfrac{1}{2}(V_{sat}-V_{th}) \leqq V_d \leqq +\tfrac{1}{2}(V_{sat}-V_{th}) \quad (2)$$

$$V_{s1}=-V_{on}-\tfrac{1}{2}(V_{sat}+V_{th}) \quad (3)$$

$$V_{s2}=-V_{on}+\tfrac{1}{2}(V_{sat}+V_{th}) \quad (4)$$

Then it holds for the reset voltage that ($V_d$ maximal):

$$V_{res}=\tfrac{1}{2}(V_{sat}-V_{th})+(V_{sat}+\Delta V)+V_{on} \quad (5)$$

and for the voltage at point Q:

$$V_Q=\tfrac{1}{2}(V_{sat}-V_{th})+(V_{sat}+\Delta V) \quad (6)$$

During the selection of the previous line, a positive pixel voltage $V_p$ (using row inversion) is written (it is assumed that a field of substantially equal grey tints is written). $V_d^+$ is the associated data voltage and is inverse to the data voltage $V_d^-$ which is necessary to write the pixel in the next selection time. It then holds that $V_d^+=-V_d^-$. For an arbitrary positive pixel it holds that (see U.S. Pat. No. 5,159,325):

$$V_p=V_d^++\tfrac{1}{2}(V_{sat}+V_{th}) \quad (7)$$

or $$V_d^+=V_p-\tfrac{1}{2}(V_{sat}+V_{th}) \quad (8)$$

During reset (at instant $t_1$) the voltage $V_c$ across the capacitance $C_p$ associated with the pixel will be:

$$V_C=V_d^+-V_Q=V_d^+-\tfrac{1}{2}(V_{sat}-V_{th})-(V_{sat}+\Delta V) \quad (9)$$

Substitution of (8) in (9) results in:

$$V_C=V_p-2V_{sat}-\Delta V \quad (10)$$

Since $V_C=V_p$ applies for reset, a charge transport in a negative sense occurs during reset:

$$\Delta Q^-=C_p(V_C-V_p)=-C_p(2V_{sat}+\Delta V) \quad (11)$$

During the subsequent selection (from instant $t_2$) the voltage across the pixel changes to a voltage $-V_p$ (the light transmissivity is the same at $+V_p$ and $-V_p$). A charge transport in a positive sense is accompanied thereby: $\Delta Q_2^+=C_p(-V_p-V_C)=C_p(2V_{sat}+\Delta V-2V_p)$. Since the total charge transport should be zero, it holds that $\Delta Q^-=\Delta Q_1^++\Delta Q_2^+$. With the previously mentioned change of charge at instant $t_4$ in a positive sense $\Delta Q_1^+=2C_pV_p$ this is complied with.

For a dark ($V_p=V_{sat}$) and a light ($V_p=V_{th}$) pixel this is shown in FIG. 4c. At the instant $t_1$ the capacitance associated with the pixel is reset from the value $V_{sat}$, or $V_{th}$ (arrow 21, or arrow 21', respectively) to the value $-(V_{sat}+\Delta V)$ or $-(V_{sat}+\Delta V+V_{sat}-V_{th})$. After writing (instant $t_2$) the pixel acquires the value $-V_{sat}$ or $-V_{th}$ (arrow 22, or 22', respectively) and when the voltage across the pixel is reversed (after instant $t_4$) it acquires the value $V_{sat}$ or $V_{th}$ (arrow 23, or 23', respectively). As is apparent from FIG. 4c, the total change of voltage for light and dark pixels is the same. However, the capacitance of a pixel is voltage-dependent. For the ratio of charge transports in black and white pixels it holds, with (11), that:

$$\Delta Q_{white}/\Delta Q_{black}=(-2C_{pmin}\cdot(V_{sat}+\Delta V))/(-2C_{pmax}\cdot(V_{sat}+\Delta V)=C_{pmin}/C_{pmax}$$

The ratio between the maximum and minimum charge transport is now determined by the ratio between the maximum and minimum pixel capacitance; dependent on the type of liquid crystal material used, it is of the order of 2. At such a ratio the phenomenon of burn-in still occurs; the MIMs which have processed a larger charge transport for a longer period of time vary more rapidly in their behaviour than the MIMs which have processed a smaller charge transport. Consequently, residual images remain visible.

According to the invention the control unit 18 is now adapted in such a way that it supplies, for example a row signal as is shown in FIG. 5a. In the selection period preceding the reset pulse 24, a second reset pulse 25 is presented at instant $t_0$, which pulse charges the capacitance associated with the pixel in a positive sense to a voltage $V_{sat}+\Delta V_1$. In this example this is effected two selection periods before the selection period $t_2$–$t_3$, in other words a signal $V_d^-$ which is minimally $V_{dmin}=-\tfrac{1}{2}(V_{sat}-V_{th})$ is presented to the column electrode. The voltage at point Q in FIG. 3 will then be:

$$V_{Q1}=-\tfrac{1}{2}(V_{sat}-V_{th})-(V_{sat}+\Delta V_1) \quad (12)$$

The capacitance $C_p$ associated with the pixel 14 is further positively charged during the extra reset from instant $t_0$ to a voltage:

$$V_{C1}=V_d^--V_{Q1}=-V_d^++\tfrac{1}{2}(V_{sat}-V_{th})+(V_{sat}+\Delta V_1) \quad (13)$$

Substitution of (8) in (13) yields:

$$V_{C1}=-V_p+2V_{sat}+\Delta V_1 \quad (14)$$

During the second (normal) reset from instant $t_1$ the voltage becomes again (see (10)):

$$V_C=V_p-2V_{sat}-\Delta V \quad (15)$$

The total charge transport in the negative sense then is:

$$\Delta Q^-=C_p(V_{C2}-V_{C1})=-C_p(4V_{sat}-2V_p+\Delta V_1+V) \quad (16)$$

The computed negative charge transport at instant $t_1$ for a pixel of a given luminance is compensated by positive charge transport at the instants $t_0$, $t_2$ and $t_4$. This is further shown in FIG. 5c. Before the actual resetting operation takes place, the capacitance associated with the pixel is charged with the second reset pulse at instant $t_0$ to $(V_{sat}+\Delta V_1)$ or $(V_{sat}+\Delta V_1+V_{sat}-V_{th})$, (arrows 26, 26'). At the instant $t_1$ the capacitance associated with the pixel is reset from the value $(V_{sat}+\Delta V_1 1)$ (arrow 21) to the value $-(V_{sat}+\Delta V)$ or from $(2V_{sat}+\Delta V_1-V_{th})$ to $-(V_{sat}+\Delta V+V_{sat}-V_{th})$ (arrow 21'). After writing (instant $t_2$) the pixel acquires the value $-V_{sat}$ or $-V_{th}$ (arrow 22, or arrow 22', respectively) and when the voltage across the pixel is reversed (after instant $t_4$) it acquires the value $V_{sat}$ again, or $V_{th}$ (arrow 23, or 23', respectively). As is apparent from FIG. 5*c*, the total voltage change for light pixels is now larger than for dark pixels, while the capacitance is smaller for light pixels. This results in a compensation for the variation of capacitance. For an arbitrary example it holds, for example that $\Delta V=1$ V and $\Delta V_1=0$ V (the extra resetting operation need not be effected accurately). For an arbitrary liquid crystal material (ZLI 84460 of the firm of Merck) it holds, for example that $V_{th}=1.5$ V and $V_{sat}=4.5$ V, while $C_{pmax}/C_{pmin}=1.8$ and 2.2, respectively. With $C'_{pmax}/C_{pmin}=2.2$ and the formula for the pixel capacitance:

$$C_p=C'_{pmax}-(C'_{pmax}-C_{pmin})(V_{th}/V_{sat}) \tag{17}$$

the charge transport can be determined as a function of the pixel voltage. ($C'_{pmax}$: pixel capacitance for $V_p>>V_{sat}$.) This is shown in FIG. 6 (line a; line b shows the same function for the device of FIG. 4). It appears therefrom that the ratio $\Delta Q_{white}/\Delta Q_{black}$ is still only approximately 0.9. A larger ratio $\Delta Q_{white}/\Delta Q_{black}$ of approximately 1.15 now occurs for a grey level at $V_p=2.8$ V.

FIG. 7*a* shows another variation of the row signals as can be supplied by control unit 18. FIG. 7*b* again shows data signals for pixels having substantially the same light transmissivity. The second reset signal now has the same polarity and (at least in this example) the same voltage value as the actual reset signal. During the extra reset pulse, the voltage across the capacitance $C_p$ associated with the pixel 14 is charged to a value $-(V_{sat}+\Delta V)$. Analogous to the equations (5) to (10) it holds at the end of the period $t_6$–$t_7$ that:

$$V_C=V_p-2V_{sat}-\Delta V \tag{18}$$

Before the extra reset pulse 25 the pixel voltage was $V_p^-=-V_p$. This means that a charge transport in a negative sense is effected at a value of:

$$\Delta Q_1^-=C_p(V_C-V_{p-})=-C_p(2V_{sat}+\Delta V-2V_p) \tag{19}$$

At the instant $t_1$ there is a negative charge transport analogous to that in the previous examples at a value of (equation (11)):

$$\Delta Q_2^-=-C_p(2V_{sat}+\Delta V) \tag{20}$$

The total charge transport in the negative sense then is:

$$\Delta Q^-_{tot}=\Delta Q_1^-+\Delta Q_2^-=-C_p(4V_{sat}+2\Delta V-2V_p) \tag{21}$$

This expression is substantially identical to equation (16). With $\Delta V=0.5$ V the same characteristic is found as in FIG. 6. An advantage of this embodiment is that there is no extra voltage level required for the reset voltage.

The computed negative charge transport at the instants $t_1$ and $t_6$ for a pixel having a given luminance is compensated by positive charge transport at the instants $t_0$, $t_2$ and $t_4$. This is further shown in FIG. 7*c*. At the instant $t_1$ the capacitance associated with the pixel is reset from the value $V_{sat}$, or $V_{th}$ (arrow 21 or 21', respectively) to the value $-(V_{sat}+\Delta V)$ or $-(V_{sat}+\Delta V+V_{sat}-V_{th})$. After writing (instant $t_2$) the pixel acquires the value $-V_{sat}$, or $-V_{th}$ (arrow 22 or 22', respectively). For reversing the voltage across the pixel (after instant $t_4$) the capacitance associated with the pixel is reset from the value $-V_{sat}$ or $-V_{th}$ (arrow 27 or 27', respectively) to the value $-(V_{sat}+\Delta V)$ or $-(V_{sat}+\Delta V+V_{sat}-V_{th})$. After the instant $t_4$ the pixel acquires the value $V_{sat}$ or $V_{th}$ again (arrow 23 or 23', respectively). In FIG. 7*c* the total change of voltage for light and dark pixels is now equal to the sum of the charge transports determined by the voltage changes associated with the arrows 22, 22' and 23, 23' in a positive sense, or 21, 21' and 27, 27' in a negative sense. As described hereinbefore, the difference in capacitances is again compensated for the ratio of the associated charge transports by the increased voltage change across the white pixels (having the small capacitance).

Figure 8A:
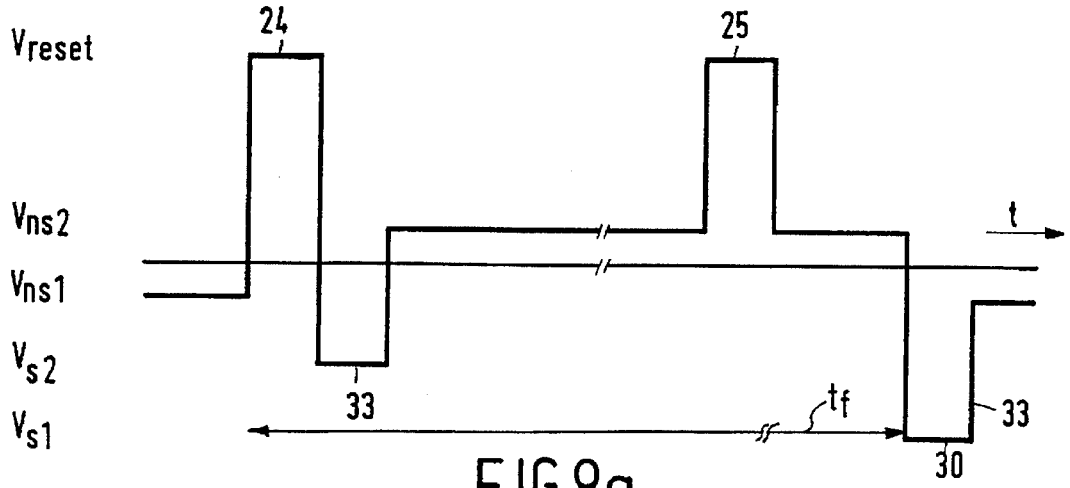
Figure 8B:
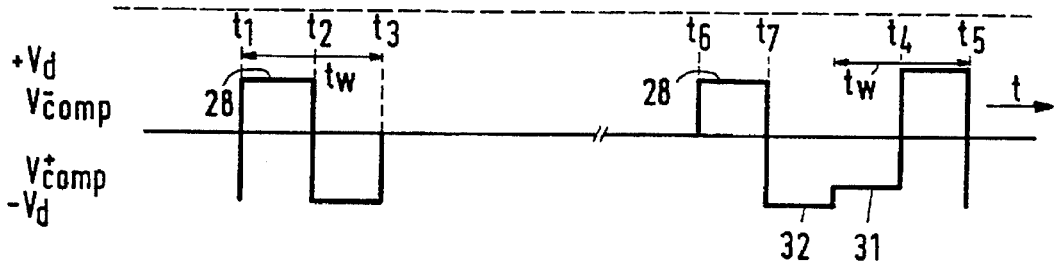
Figure 8C:
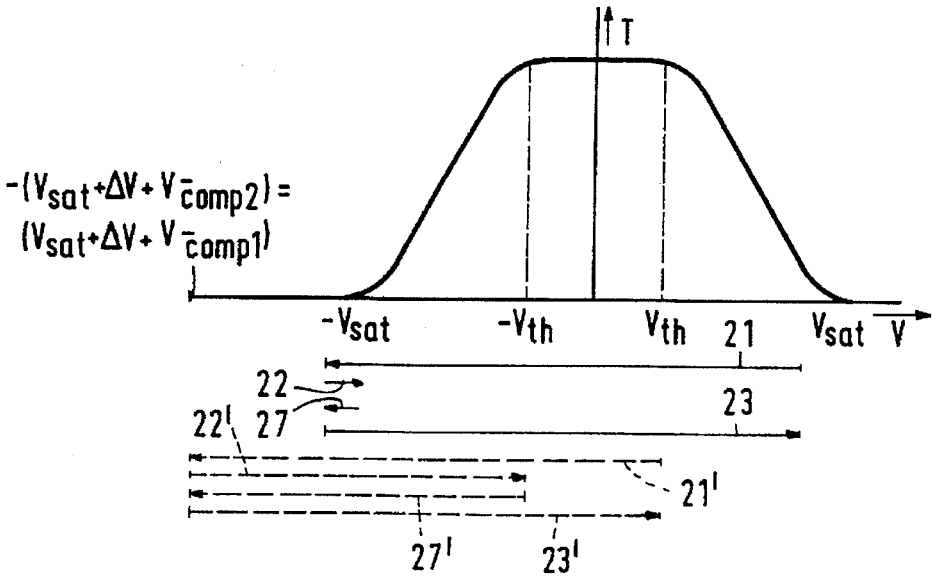

The second reset pulse 25 need not be presented immediately for selection. Due to the inertia of the liquid crystal material, a change across the pixel capacitance will not become immediately manifest in a change of light transmissivity. This fact is utilized in a display device whose row selection signal supplied by the control unit 18 is shown in FIG. 8*a*. The control unit 16 is now adapted in such a way (for example, with a preprocessor, not shown, which processes incoming signals and, if necessary, temporarily stores them) that simultaneously with the reset signals to the selected row the data register 17 presents compensation signals 28 (FIG. 8*b*). For these compensation signals it holds in this example that:

$$|V_{comp}|\leqq|V_{dmax}|$$

(The compensation signals to be presented then remain within the range of the data signals).

Before the reset pulse, the pixel voltage is $V_p^+$. During the reset at instant $t_1$ (and also during the extra reset at instant $t_6$) the voltage $V_C$ across the capacitance $C_p$ associated with the pixel is:

$$V_C=V^-_{comp}-\tfrac{1}{2}(V_{sat}-V_{th})-(V_{sat}+\Delta V) \tag{22}$$

Prior to the reset pulse (instant $t_1$) the pixel voltage is $V_p^+$. The charge transport in a negative sense then is:

$$\Delta Q^-_1=-C_p(V^+_p-V^-_{comp}+\tfrac{1}{2}(V_{sat}-V_{th})+(V_{sat}+\Delta V) \tag{23}$$

Prior to the extra reset pulse (instant $t_6$) the pixel voltage is $V_p^-$, The charge transport in the negative sense now is:

$$\Delta Q^-_2=-C_p(-V^+_p-V^-_{comp}+\tfrac{1}{2}(V_{sat}-V_{th})+(V_{sat}+\Delta V) \tag{24}$$

For the total charge transport in the negative sense it now holds that:

$$\Delta Q^-_{tot}=\Delta Q^-_1+\Delta Q^-_2=-C_p(-2\,V^-_{comp}+3\,V_{sat}-V_{th}+2\Delta V) \tag{25}$$

The compensation voltages for a given electro-optical medium can then be computed by means of equation (17). For a liquid crystal material with $V_{th}=1.5$ V and $V_{sat}=4.5$ V and $C'_{pmax}/C_{pmin}=2.2$, for example, the curve 29 in FIG. 9 is found for the compensation voltage which, as a function of the pixel voltage, is necessary to keep $\Delta Q^-_{tot}$ constant, independently of the transmission value or the pixel voltage. To illustrate this, the charge transport is shown as a function of the pixel voltage in FIG. 10. It appears therefrom that the ratio $\Delta Q_{white}/\Delta Q_{black}=1$. There is an exception at pixel voltages of between 1.5 V and 1.7 V because the compensation voltages are limited by the condition $|V_{comp}|\leqq|V_{dmax}|$. If this condition is not imposed, the solid lines apply in FIGS. 9 and 10 in the range between 1.5 V and 1.7 V; if said condition is imposed, the broken lines (line 29' in FIG. 9)

apply. The compensation pulse 28 (coinciding with the extra reset pulse 25) can immediately be presented before the selection pulse 30 so that the instants $t_7$ and $t_4$ coincide. In this example an inverse compensation pulse 31 and an inverse data signal 32 to reduce crosstalk are presented in the intermediate period of time.

The computed negative charge transport at the instants $t_1$ and $t_6$ for a pixel having a given luminance is compensated by positive charge transport at the instants $t_2$ and $t_4$. This is further shown in FIG. 8*c*. At the instant $t_1$ the capacitance associated with the pixel is reset from the value $V_{sat}$ or $V_{th}$ (arrow 21 or 21', respectively) to the value $-(V_{sat}+\Delta V+\frac{1}{2}(V_{sat}-V_{th})-V^{-}_{comp1})$ or $-(V_{sat}+\Delta V+\frac{1}{2}(V_{sat}-V_{th})-V^{-}_{comp2})$ in which $V^{-}_{comp1}=\frac{1}{2}(V_{sat}-V_{th})$. After writing (instant $t_2$) the pixel acquires the value $-V_{sat}$ or $-V_{th}$ (arrow 22, or 22', respectively). For reversing the voltage across the pixel (after instant $t_4$) the capacitance associated with the pixel is reset from the value $-V_{sat}$ or $-V_{th}$ (arrow 27, or 27', respectively) to the value $-V_{sat}-\Delta V-V^{-}_{comp1}$ or $-V_{sat}-\Delta V-V^{-}_{comp2}$. After the instant $t_4$ the pixel acquires the value $V_{sat}$ or $V_{th}$ again (arrow 23, or 23', respectively). The voltage changes for light and dark pixels now again compensate the capacitance differences so that the sum of the charge transports determined by the voltage changes associated with the arrows 22, 22' and 23, 23' in a positive sense or 21, 21' and 27, 27' in a negative sense is zero.

In this example extra voltages (the compensation voltages) are presented to the column electrodes, which voltages are dependent on the data signals to be presented. If the row selection periods $t_w^1$, $t_w^2$ correspond to a line period in television applications (64 μsec in the PAL system) the row of pixels is reset in the examples of FIGS. 5, 7 during the selection of a previous row; reset and data voltages are chosen to be such that a good reset is ensured so that resetting does not have any direct influence on the subsequent selection. As described for the example of FIG. 4 in U.S. Pat. No. 5,159,325, the reset and data voltages may also be presented within one row selection period $t_w$ corresponding to a line period in television applications.

If the row selection periods $t_w^1$, $t_w^2$ correspond to a line period in television applications, the compensation signals 28, 31 in the example of FIG. 8 are presented to the column electrodes upon selection of a previous row and during resetting of a row of pixels. Since these compensation signals do not necessarily correspond to the dam signals to be presented,, the selection pulses 30 and 33 are presented during the last part of a selection period $t_w$ so that the compensation pulse 28 coincides with the reset pulse 24, and the inverted compensation pulse 31 during the first part of the selection period $t_w$ is simultaneously presented with a non-selection voltage $V_{ns2}$. Since the row electrode is now not selected, the voltage across the pixels is not influenced by the inverted compensation pulses.

The same applies to another embodiment of a display device in which no second reset voltage is presented to the row electrodes. The row signal throughout a drive cycle (FIG. 11*a*) has the same variation as that in FIG. 4*a*. From the instant $t_1$ and during a part of a row selection period $t_w$ a reset voltage $V_{res}$ is presented to the row electrode and a compensation voltage $V_{comp}$ is presented to the column electrode in such a way that the capacitance $C_p$ associated with the pixel 14 is charged to a value $-(V_{sat}+\Delta V+\frac{1}{2}(V_{sat}-V_{th})-V_{comp})$ for an arbitrary pixel voltage $V_p$. If $V_p=V_{sat}$, the compensation voltage will be $V_{compsat}=\frac{1}{2}(V_{sat}-V_{th})$, which is low enough to bring the pixel to an extreme transmission state. During the remaining period of the row selection period $t_w$ a selection voltage $V_{s1}$ is subsequently presented from instant $t_2$ to instant $t_3$, while a voltage $-V_d$ (FIG. 11*b*) is simultaneously presented to the column electrode. From $t_3$ the row electrode is no longer selected because a non-selection voltage (hold voltage) $V_{ns2}$ is presented. In a subsequent frame time a selection signal $V_{s2}$ is presented to the row electrode during selection (from $t_4$), while an inverted data signal $+V_d$ is presented to the column electrode. The voltage $V_p$ across the pixel is inverted, whereafter a non-selection voltage (hold voltage) $V_{ns1}$ is presented to the row electrode 7.

The extreme voltage change (hence the extreme charge transport) occurs when the voltage across a pixel changes from $V_{sat}$ to $-(V_{sat}+\Delta V)$ (corresponding to arrow 21 in FIG. 11*c*) or from $V_{th}$ to $-(V_{sat}+\Delta V+\frac{1}{2}(V_{sat}-V_{th})-V_{compth})$. At the instant $t_1$ the capacitance associated with the pixel is reset from the value $V_{sat}$ or $V_p$ (arrow 21, or 21', respectively) to the value $-(V_{sat}+\Delta V)$ or $-(V_{sat}+\Delta V+\frac{1}{2}(V_{sat}+V_{th})-V_p)$. At an arbitrary data voltage the compensation voltage $V_{comp}$ is presented at instant $t_1$ (which voltage is computed, for example via a preprocessor coupled to the data register 17 or a look-up table) so that the total voltage change compensates the capacitance change. After writing (instant $t_2$) the pixel acquires the value $-V_{sat}$ or $-V_p$ (arrow 22, or 22', respectively) and when the voltage across the pixel is reversed (after instant $t_4$) it acquires the value $V_{sat}$ or $V_p$ again (arrow 23, or 23', respectively).

We claim:

1. A display device comprising an electro-optical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with an arbitrary state of light transmissivity, characterized in that the drive means are provided with means for limiting the maximum ratio between the charge transport for pixels having an arbitrary light transmissivity and the charge transport for pixels having an extreme light transmissivity during a full drive cycle to a value smaller than $$\frac{C_{pmax}}{C_{pmin}},$$

in which $C_{pmax}$ and $C_{pmin}$ are the maximum and minimum values between which the capacitance of a capacitor associated with the pixel varies during operation.

2. A display device comprising an electro-optical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with an arbitrary state of light transmissivity, characterized in that the drive means are provided with means for limiting the maximum ratio between the charge transport for pixels having an arbitrary light transmissivity and the charge transport for pixels having an extreme light transmissivity during a full drive cycle to a value of between 0.7 and 1.5.

3. A display device as claimed in claim 1 or claim 2, characterized in that the maximum ratio is between 0.9 and 1.1.

4. A display device as claimed in claim 1, or claim 2 characterized in that the electro-optical medium comprises a twisted nematic liquid crystal.

5. A display device as claimed in claim 1 or claim 2, characterized in that the drive means comprise means which limit the ratio between the charge transport for pixels having a second extreme light transmissivity and the charge transport for pixels having the extreme light transmissivity throughout a drive cycle to a value of between 0.75 and 1.3.

6. A display device as claimed in claim 5, characterized in that the drive means comprise means which limit the maximum ratio between the charge transport for pixels having a second extreme light transmissivity and the charge transport for pixels having the extreme light transmissivity throughout a drive cycle to a value of substantially 1.

7. A display device as claimed in claim 1 or claim 2, characterized in that the drive means are provided with means for charging the pixel to a second auxiliary voltage beyond or on the edge of the voltage range to be used for picture display.

8. A display device as claimed in claim 7, characterized in that the drive means are provided with means for first charging the pixel to a second auxiliary voltage whose sign is opposite to that of the first auxiliary voltage and for subsequently charging the pixel to the first auxiliary voltage.

9. A display device comprising an electro-optical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with the given state of light transmissivity, characterized in that the drive means are provided with means for first charging the pixel to a second auxiliary voltage whose sign is opposite to that of the first auxiliary voltage and for subsequently charging the pixel to the first auxiliary voltage.

10. A display device as claimed in claim 9, characterized in that the means for supplying the first and second auxiliary voltages comprise a row selection circuit which can provide the row electrodes with first and second reset voltages of opposite sign during two consecutive row selection periods.

11. A display device comprising an electro-optical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with the given state of light transmissivity, characterized in that the drive means are provided with means for charging the pixel to a second auxiliary voltage which has the same sign as the first auxiliary voltage and for subsequently charging the pixel to a voltage having an opposite sign and a smaller amplitude associated with the given state of light transmissivity.

12. A display device as claimed in claim 11, characterized in that the means for supplying the first and second auxiliary voltages comprise a row selection circuit which can provide the row electrode with first and second reset voltages of the same sign at least during parts of the row selection periods and during two row selection periods which are offset with respect to time.

13. A display device as claimed in claim 12, characterized in that the first and the second reset voltage have substantially the same amplitude.

14. A display device as claimed in claim 1 or claim 2, characterized in that the means for charging the pixel to a first auxiliary voltage comprise a row selection circuit for presenting reset voltages during a period which is shorter than a row selection period, and means for providing the column electrodes with compensation voltages during presentation of the reset voltage.

15. A display device comprising an electro-optical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with the given state of light transmissivity, characterized in that the means for charging the pixel to a first auxiliary voltage comprise a row selection circuit for presenting reset voltages during a period which is shorter than a row selection period, and means for providing the column electrodes with compensation voltages during presentation of the reset voltage.

16. A display device comprising an electrooptical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with an arbitrary state of light transmissivity, characterized in that the drive means are provided with means for limiting the maximum ratio between the charge transport for pixels having an arbitrary light transmissivity and the charge transport for pixels having an extreme light transmissivity during a full drive cycle to a value smaller than $C_{pmax}/C_{pmin}$, in which $C_{pmax}$ and $C_{pmin}$ are the maximum and minimum values between which the capacitance of a capacitor associated with the pixel varies during operation, and wherein the drive means for limiting the maximum ratio include means for first charging the pixel to a second auxiliary voltage beyond or on the edge of the voltage range to be used for picture display and whose sign is opposite to that of the first auxiliary voltage and for subsequently charging the pixel to the first auxiliary voltage.

17. A display device comprising an electrooptical display medium between two supporting plates and provided with row and column electrodes, which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with an arbitrary state of light transmissivity, characterized in that the drive means are provided with means for limiting the maximum ratio between the charge transport for pixels having an arbitrary light transmissivity and the charge transport for pixels having an extreme light transmissivity during a full drive cycle to a value smaller than $C_{pmax}/C_{pmin}$, in which $C_{pmax}$ and $C_{pmin}$ are the maximum and minimum values between which the capacitance of a capacitor associated with the pixel varies during operation, and wherein the drive means for limiting the maximum ratio include means for first charging the pixel to a second auxiliary voltage beyond or on the edge of the voltage range to be used for picture display and whose sign is the same as that of the first auxiliary voltage and for subsequently charging the pixel to a voltage having an opposite sign and a smaller amplitude associated with the given state of light transmissivity.

18. A display device comprising an electro-optical display medium between two supporting plates and provided with row and column electrodes. which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with the given state of light transmissivity, characterized in that the drive means are provided with means for supplying first and second auxiliary voltages and means for first charging the pixel to a second auxiliary voltage whose sign is opposite to that of the first auxiliary voltage and for subsequently charging the pixel to the first auxiliary voltage, said means for supplying the first and second auxiliary voltages comprising a row selection circuit which can provide the row electrodes with first and second reset voltages of opposite sign during two consecutive row selection periods, said drive means being further provided with means for providing the column electrodes with compensation voltages during presentation of the reset voltages during periods which are shorter than a row selection period.

19. A display device comprising an electro-optical display medium between two supporting plates and provided with row and column electrodes. which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with the given state of light transmissivity, characterized in that the drive means are provided with means for supplying first and second auxiliary voltages and means for first charging the pixel to a second auxiliary voltage which has the same sign as the first auxiliary voltage and for subsequently charging the pixel to a voltage having an opposite sign and a smaller amplitude associated with the given state of light transmissivity, said drive means being further provided with means for providing the column electrodes with compensation voltages during presentation of the reset voltages during periods which are shorter than a row selection period.

20. A display device comprising an electro-optical display medium between two supporting plates and provided with row and column electrodes. which device comprises a plurality of facing first and second picture electrodes located on the supporting plates and defining pixels in the electro-optical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with the given state of light transmissivity, characterized in that the drive means are provided with means for supplying first and second auxiliary voltages and means for first charging the pixel to a second auxiliary voltage which has the same sign as the first auxiliary voltage and for subsequently charging the pixel to a voltage having an opposite sign and a smaller amplitude associated with the given state of light transmissivity, said drive means being further provided with means for providing the column electrodes with compensation voltages during presentation of the reset voltages during periods which are shorter than a row selection period.

21. A display device comprising an electrooptical display medium between two supporting plates and provided with row and column electrodes, which device comprises a plurality of facing first and second picture electrodes located on the supporting plates and defining pixels in the electrooptical display medium, each pixel being connected to a row or column electrode via a non-linear two-pole element, the display device being further provided with drive means for applying selection and data voltages to the row and column electrodes, respectively, in order to bring a selected pixel to a given state of light transmissivity, the drive means for each pixel being provided with means for charging the pixel by means of a non-linear switching element to a first auxiliary voltage beyond or on the edge of the voltage range to be used for picture display, and means for charging the pixel by means of the same non-linear switching element from the first auxiliary voltage to a voltage having the same sign and a smaller amplitude associated with an arbitrary state of light transmissivity, characterized in that the drive means are provided with means for limiting the maximum ratio between the charge transport for pixels having an arbitrary light transmissivity and the charge transport for pixels having an extreme light transmissivity during a full drive cycle to a value smaller than $C_{pmax}/C_{pmin}$, in which $C_{pmax}$ and $C_{pmin}$ are the maximum and minimum values between which the capacitance of a capacitor associated with the pixel varies during operation, and wherein the drive means for limiting the maximum ratio include means for first charging the pixel to a second auxiliary voltage beyond or on the edge of the voltage range to be used for picture display and whose sign is opposite to that of the first auxiliary voltage and for subsequently charging the pixel to the first auxiliary voltage, said drive means for limiting the maximum ratio including means for supplying the first and second auxiliary voltages comprising a row selection circuit which can provide the row electrodes with first and second reset voltages of opposite sign during two consecutive row selection periods.

* * * * *